US006955575B1

(12) United States Patent
Hsieh

(10) Patent No.: US 6,955,575 B1
(45) Date of Patent: Oct. 18, 2005

(54) FLIPPER

(76) Inventor: Hsing-Chi Hsieh, No.51, Wan An Street, Taipei (TW)

( * ) Notice: Subject to any disclaimer, the term of this patent is extended or adjusted under 35 U.S.C. 154(b) by 0 days.

(21) Appl. No.: 10/875,632

(22) Filed: Jun. 23, 2004

(51) Int. Cl.[7] ..... A63B 31/08
(52) U.S. Cl. ..... 441/64
(58) Field of Search ..... 441/64, 61

(56) References Cited

U.S. PATENT DOCUMENTS 6,568,974 B2 * 5/2003 Semeia ..... 441/64

* cited by examiner

*Primary Examiner*—Lars A. Olson
(74) *Attorney, Agent, or Firm*—Pro-Techtor Int'l Services

(57) ABSTRACT

A flipper includes a skeleton structure having a rear base portion, two longitudinally extended side rails, and a plurality of spaced supporting strips extended in a longitudinal direction; and a web structure having a foot pocket associated with the rear base portion, two sheathings forward extended from two lateral outer sides of the foot pocket for wrapping the side rails therein, and a plurality of longitudinally extended webs provided between the two sheathings to locate between and connect two adjacent supporting strips as well as the side rails and the supporting strips. The flipper has a side rail structure with good elasticity and toughness to provide good water kicking and propelling force. A longitudinally extended slit may be provided on at least one of the webs and have a zipper provided thereat to freely adjust the length of the slit and accordingly the propelling force of the flipper.

7 Claims, 6 Drawing Sheets

FLIPPER

FIELD OF THE INVENTION

The present invention relates to a flipper, and more particularly to a flipper having low weight and good toughness, and providing good propelling effect.

BACKGROUND OF THE INVENTION

A flipper has an expanded blade that enables an increased propelling force when a diver kicks water, and therefore helps the diver to move quickly under water.

The blade of the flipper preferably has a proper rigidity matching the diver's kicking force, so as to produce a propelling force to move the diver forward. The blade is also provided at two outer sides with elastic and tough side rails to enhance the side strength of the blade and provide the blade with a restoring force for the blade to restore from a bent and deformed state during kicking water.

The currently available flippers normally include a plurality of rigid skeleton plates obliquely arranged on the blades, and a flexible web structure associated with the skeleton plates in the process of molding.

The flexible web structure is made of rubber and integrally formed at each outer side with a side rail having a particularly enlarged cross section to give the blade fixed outer edges and sufficient elasticity to restore the blade from a bent and deformed state during kicking water.

Since the side rails on the blade of the conventional flipper are made of a soft material and do not internally include any tough supporting structure, they must be particularly thick to effectively support the weight of the blade and possess sufficient elasticity and toughness for the blade to restore from the deformed state. The thick side rails would inevitably increase the volume at two lateral sides of the blade and the overall weight of the flipper, forming an increased load to the diver to consume more strength during kicking water. Moreover, the rigid skeleton plates of the conventional flippers are obliquely arranged on the blade instead of being lengthwise extended on the blade. The obliquely arranged skeleton plates prevent the blade from deforming in a transverse direction like a bowl, and accordingly, lead to reduced kicking force and propelling force.

SUMMARY OF THE INVENTION

A flipper according to the present invention includes a skeleton structure having a rear base portion, two longitudinally extended side rails, and a plurality of spaced supporting strips extended in a longitudinal direction; and a web structure having a foot pocket associated with the rear base portion, two sheathings forward extended from two lateral outer sides of the foot pocket for wrapping the side rails therein, and a plurality of longitudinally extended webs provided between the two sheathings to locate between and connect two adjacent supporting strips as well as the side rails and the supporting strips. With the side rails wrapped by the sheathings, it is not necessary for the side rails to have an excessively large cross section while the sheathed side rails can still effectively increase the side strength of the blade of the flipper and give the blade good toughness and elasticity to restore from a bent and deformed state. Since the supporting strips and the webs all are longitudinally arranged on the blade of the flipper, the blade is easily deformed in a transverse direction like a bowl when the diver kicks water, and thereby increases the propelling force of the flipper.

The flipper of the present invention is also characterized in a longitudinally extended slit provided on at least one of the webs of the web structure. The slit enables a diver to kick water with reduced energy and changes the propelling force of the flipper.

The flipper of the present invention is also characterized in that the slit has a zipper provided thereat to freely adjust the length of the slit and accordingly the propelling force of the flipper.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Please refer to FIGS. 1 to 6, in which a flipper according to an embodiment of the present invention is shown. As shown, the flipper of the present invention mainly includes a skeleton structure 1, and a flexible web structure 2.

Figure 1:
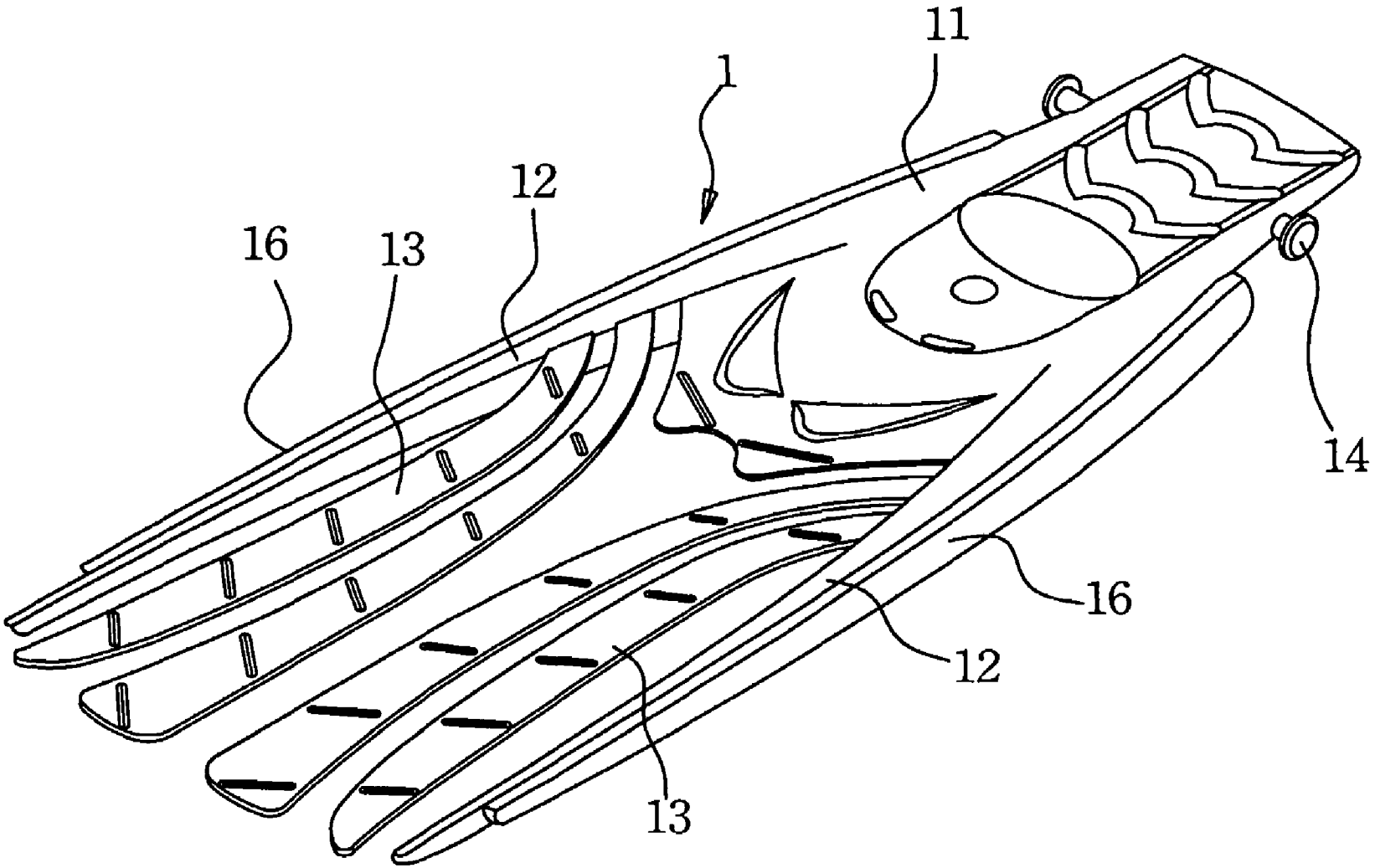
FIG. 1 is a perspective view of a skeleton structure for a flipper of the present invention.

Please refer to FIG. 1 that is a perspective view of the skeleton structure 1 for the flipper of the present invention. The skeleton structure 1 is made of a tough material, such as a plastic material, and includes a rear base portion 11, a side rail 12 forward extended from each lateral side of the rear base portion 11 in a longitudinal direction of the flipper, a plurality of spaced supporting strips 13 forward extended from a rear inner side of each side rail 12 in a substantially longitudinal direction, a button 14 provided at each rear outer side of the rear base portion 11, and a heel strap 15 mounted between the two buttons 14 for fastening around a diver's heel.

Figure 2:
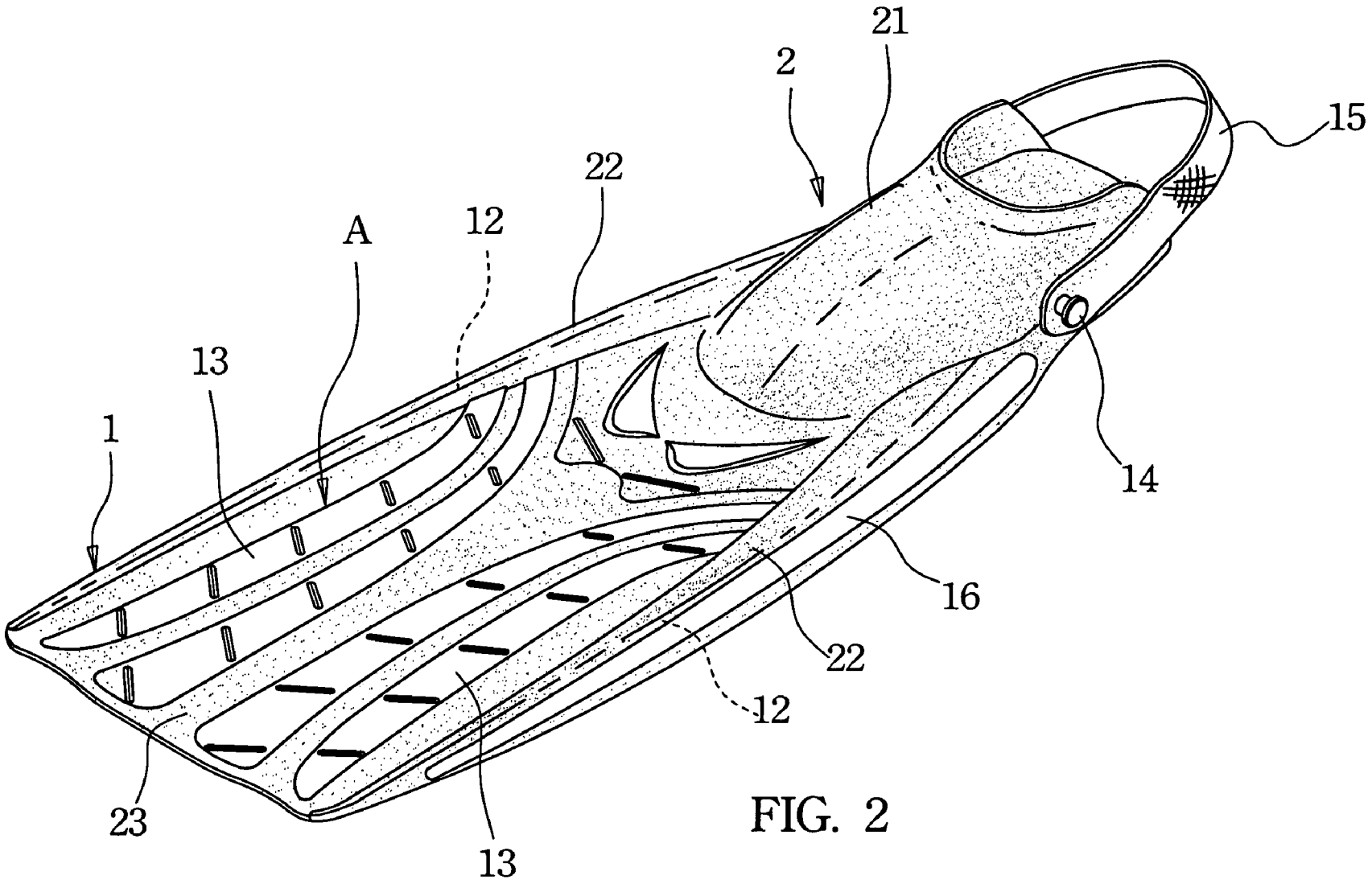
FIG. 2 is a perspective view of a flipper according to an embodiment of the present invention.

FIG. 2 is a perspective view of the web structure 2 for the flipper of the present invention. The web structure 2 is made of a soft flexible material, such as rubber, and is associated with the skeleton structure 1 when it is formed in molds. The soft flexible web structure 2 includes a foot pocket 21 associated with the rear base portion 11 of the skeleton structure 1 to locate above the rear base portion 11, a sheathing 22 forward extended from each lateral outer side of the foot pocket 21 in a longitudinal direction for wrapping the side rail 12 of the skeleton structure 1, and a plurality of longitudinally extended webs 23 provided between the two sheathings 22 to locate between and connect two adjacent supporting strips 13 as well as the side rails 12 and the supporting strips 13. The longitudinal supporting strips 13, the longitudinal webs 23, the side rails 12, and the sheathings 22 together form a blade A of the flipper.

Figure 3:
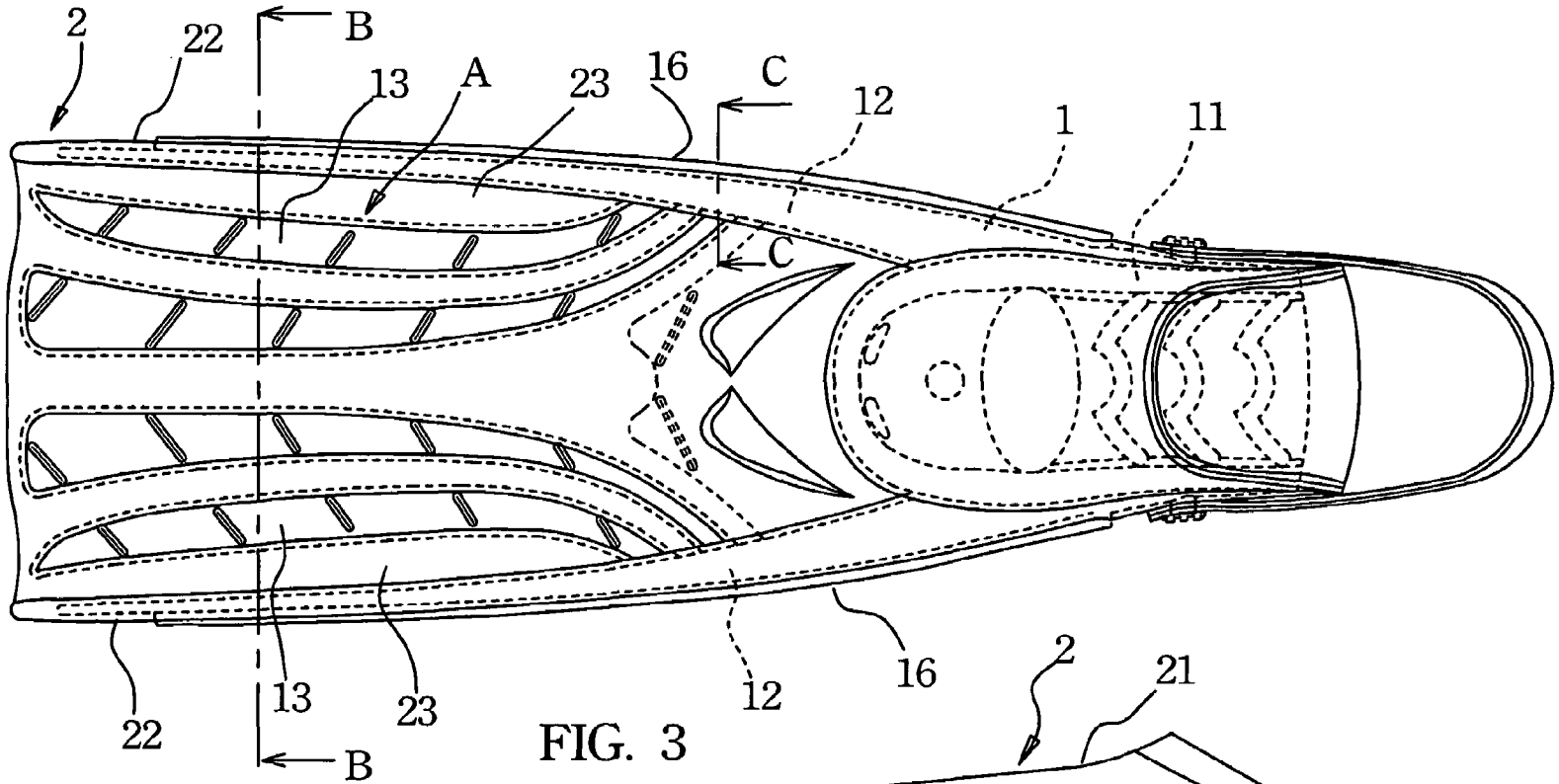
FIG. 3 is a top plan view of the flipper of FIG. 2.
Figure 4:
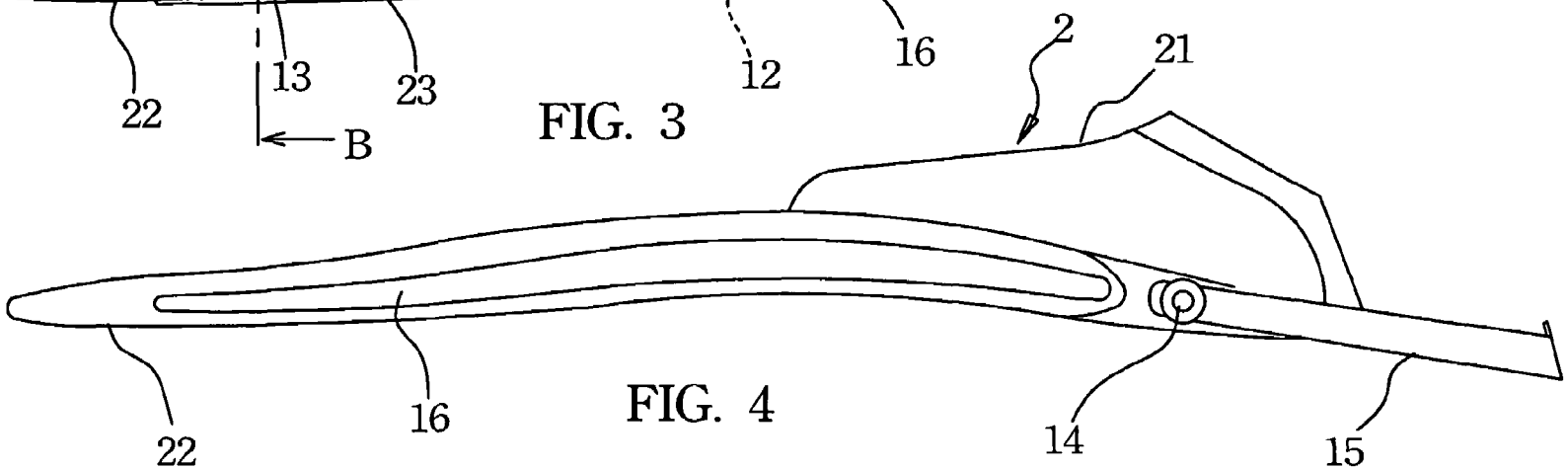
FIG. 4 is a side view of the flipper of FIG. 2.

As can be seen from FIG. 1, each of the side rails 12 is provided along a longitudinal outer side with a sideward projected portion 16, which is projected from an outer side of the sheathing 22 of the web structure 2 when the skeleton and the web structure 1, 2 are associated with one another in the process of molding, so as to strengthen a binding force between the skeleton and the web structure 1, 2. FIGS. 3 and 4 are top plan and side views, respectively, of the flipper of the present invention with the above-described structure, and FIGS. 5 and 6 are sectional views taken along lines B—B and C—C, respectively.

Figure 5:
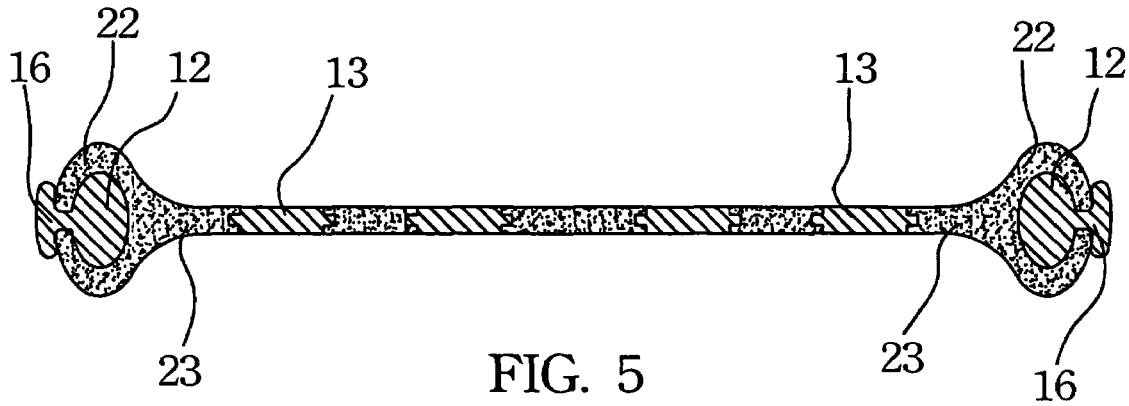
FIG. 5 is a sectional view taken along line B—B of FIG. 3.
Figure 6:
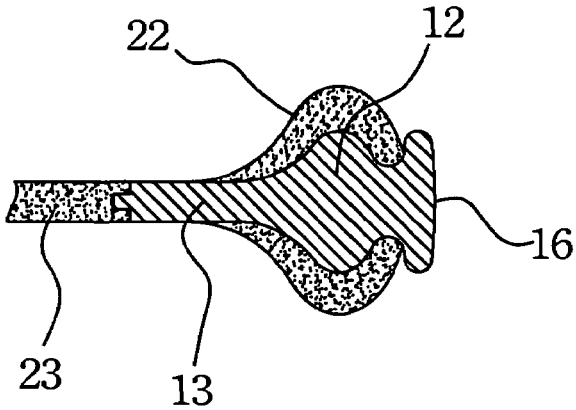
FIG. 6 is a sectional view taken along line C—C of FIG. 3.

As can be clearly seen from FIGS. 5 and 6, the blade A of the flipper of the present invention includes tough side rails 12 that are located in the sheathings 22. Therefore, it is not necessary for the side rails 12 to have an excessively large cross section while the sheathed side rails 12 can still effectively increase the side strength of the blade A and give the blade A good toughness and elasticity to provide the flipper with good ability to restore from a bent and deformed state when the diver kicks water. The sheathed side rails 12 without an excessively large cross section also enables a relatively small volume and weight thereof to reduce an overall weight of the flipper as well as the force exerted by the diver to kick water. The diver can therefore largely save his or her strength while diving.

As can be seen from the drawings, the supporting strips 13 and the webs 23 are longitudinally arranged on the blade A of the flipper. With these arrangements, the supporting strips and the webs work together to enable the blade A to transversely deform like a bowl when the diver kicks water, and thereby enable an enhanced water kicking effect, including increased kicking and propelling forces.

Figure 7:
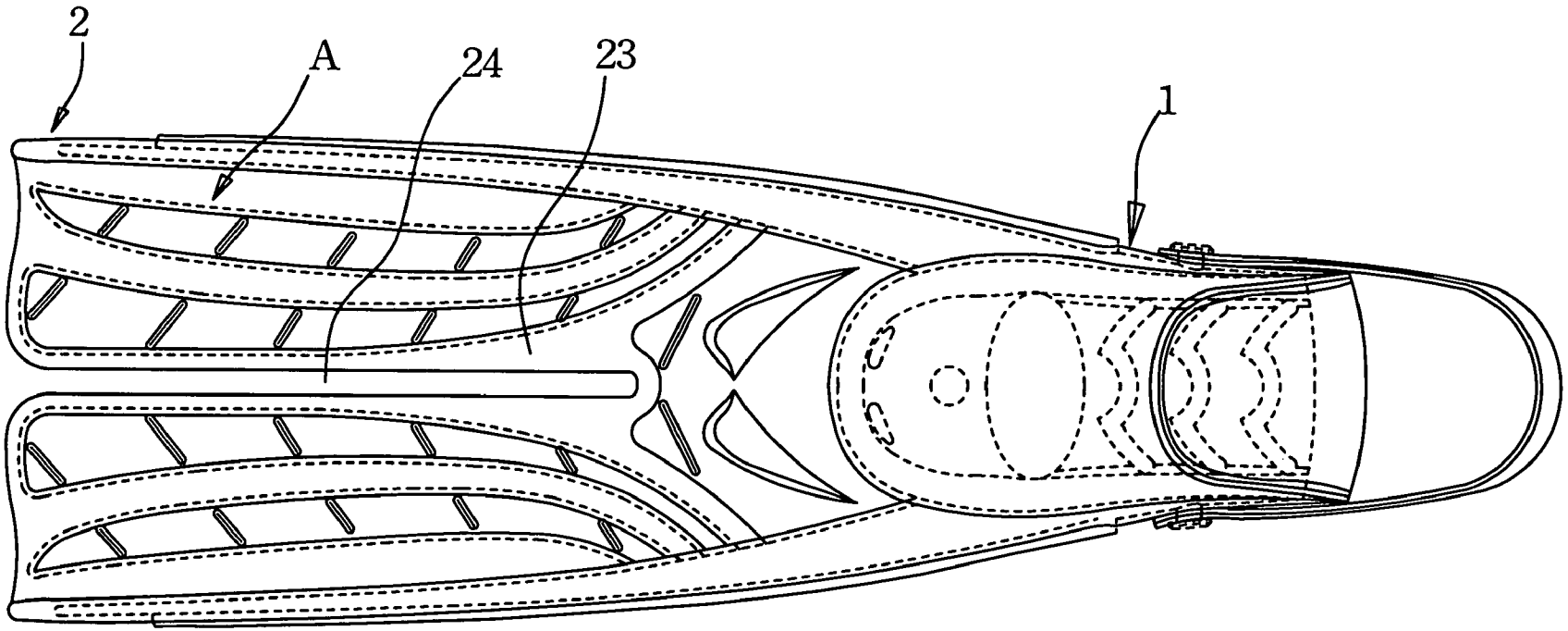
FIG. 7 is a top plan view of a flipper according to another embodiment of the present invention.

FIG. 7 is a top plan view of a flipper according to another embodiment of the present invention. In this embodiment, the web structure 2 of the blade A is provided on at least one of the longitudinal webs 23, for example, the web 23 located at a central area of the blade A, with a longitudinal slit 24 rearward extended from a front end of the blade A. When a diver kicks water, the slit 24 forms a passage for the water to pass therethrough and thereby decreases the force needed by the diver to kick water and changes the propelling force provided by the flipper.

Figure 8:
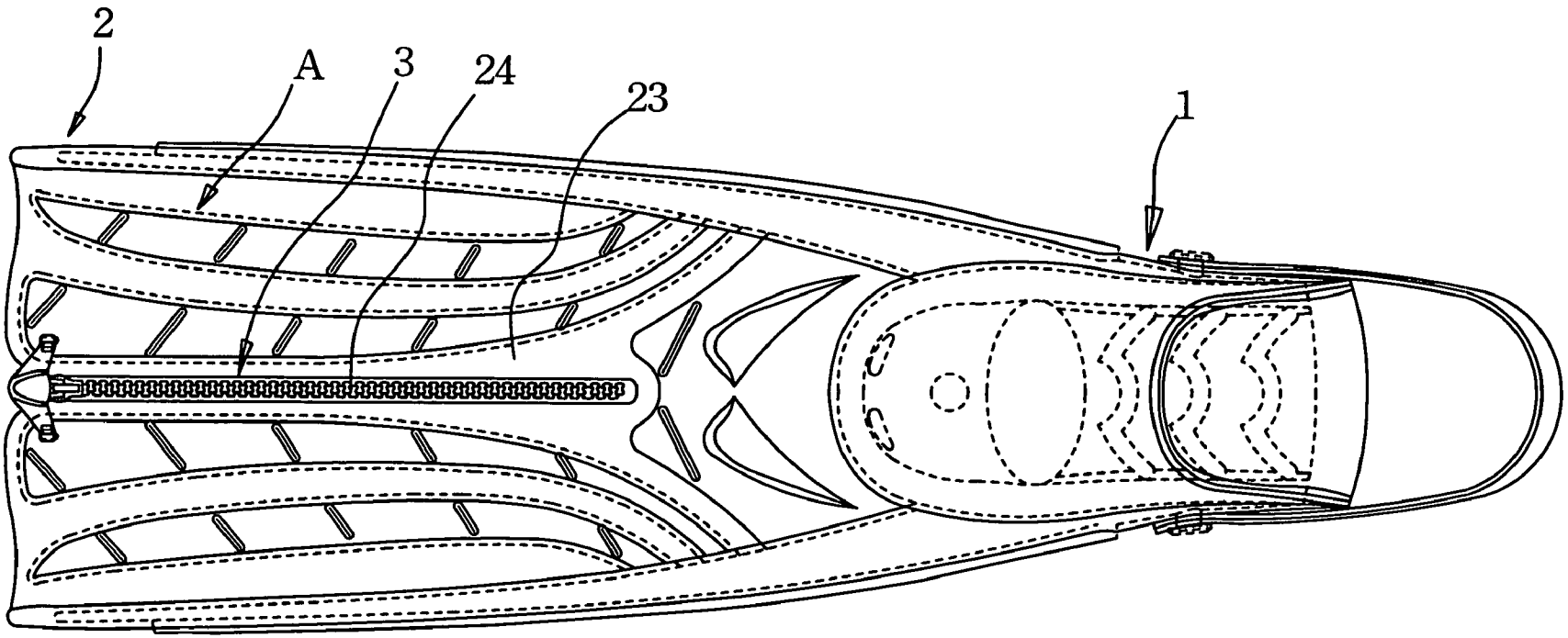
FIG. 8 is a top plan view of a flipper according to a further embodiment of the present invention.

FIG. 8 is a top plan view of a further embodiment of the present invention. In this embodiment, a slit 24 having a zipper 3 provided thereat is formed on the blade A. The zipper 3 may be zippered or opened by different lengths to freely adjust the propelling force of the flipper.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A flipper comprising:

a skeleton structure including a rear base portion, a side rail forward extended from each lateral outer side of said rear base portion in a longitudinal direction of said flipper, and a plurality of spaced supporting strips forward extended from a rear inner side of each said side rail in a substantially longitudinal direction; and a web structure including a foot pocket associated with said rear base portion of said skeleton structure to locate above said rear base portion, a sheathing forward extended from each lateral outer side of said foot pocket in a longitudinal direction for wrapping said side rail of said skeleton structure therein, and a plurality of longitudinally extended webs provided between said two sheathings to locate between and connect two said supporting strips that are adjacent to each other as well as said side rails and said supporting strips;

wherein each of said side rails of said skeleton structure is provided along a longitudinal outer side with a sideward projected portion, which is projected from an outer side of said sheathing of said web structure.

2. The flipper as claimed in claim 1, wherein said web structure is provided on at least one of said longitudinal webs with a slit rearward longitudinally extended from a front end of said flipper.

3. The flipper as claimed in claim 2, wherein said slit is provided on one of said webs located at a central area of said web structure.

4. The flipper as claimed in claim 2, wherein said slit has a zipper provided thereat.

5. A flipper comprising:

a skeleton structure including a rear base portion, a side rail forward extended from each lateral outer side of said rear base portion in a longitudinal direction of said flipper, and a plurality of spaced supporting strips forward extended from a rear inner side of each said side rail in a substantially longitudinal direction; and a web structure including a foot pocket associated with said rear base portion of said skeleton structure to locate above said rear base portion, a sheathing forward extended from each lateral outer side of said foot pocket in a longitudinal direction for wrapping said side rail of said skeleton structure therein, and a plurality of longitudinally extended webs provided between said two sheathings to locate between and connect two said supporting strips that are adjacent to each other as well as said side rails and said supporting strips;

wherein said web structure is provided on at least one of said longitudinal webs with a slit rearward longitudinally extended from a front end of said flipper, and wherein said slit has a zipper provided thereat.

6. The flipper as claimed in claim 5, wherein each of said side rails of said skeleton structure is provided along a longitudinal outer side with a sideward projected portion, which is projected from an outer side of said sheathing of said web structure.

7. The flipper as claimed in claim 5, wherein said slit is provided on one of said webs located at a central area of said web structure.

* * * * *